US005520196A

United States Patent [19]

Yang

[11] Patent Number: 5,520,196

[45] Date of Patent: May 28, 1996

[54] CIGARETTE CASE EQUIPPED WITH DISPOSABLE ASH RECEPTACLE

[76] Inventor: Dong B. Yang, Hyundae Apt. 104-101, Seonhwa-dong 151-1, Jung-ku, Daejeon, Rep. of Korea

[21] Appl. No.: 337,502

[22] Filed: Nov. 8, 1994

[30] Foreign Application Priority Data

Nov. 23, 1993 [KR] Rep. of Korea ..... 1993-24736 U

[51] Int. Cl.[6] ..... A24F 19/00

[52] U.S. Cl. ..... 131/238; 131/329; 206/246

[58] Field of Search ..... 131/238, 239; 206/87, 85

[56] References Cited

U.S. PATENT DOCUMENTS 2,777,569 1/1957 Starke, Jr. ..... 131/238

2,944,555 7/1960 Peel et al. ..... 131/238

4,789,059 12/1988 Kim ..... 206/246

*Primary Examiner*—V. Milliou

*Assistant Examiner*—Charles W. Anderson

[57] ABSTRACT

A cigarette case equipped with a plurality of disposable ash receptacles. The cigarette case comprises an inner case for containing a pack of cigarettes, an inner cap covering an upper opening of the inner case, an ash receptacle consisting of a plurality of stacked sheet pockets such as silver paper pockets in which the inner case is inserted and which is formed at its upper portion with an ash inlet, a snap extinguishing member provided at a side of the inner case, an outer case for receiving the inner case, the ash receptacle and the snap extinguishing member which is formed at its upper portion with a cutout portion so as to open the ash inlet therethrough, an outer cap covering an upper opening of the outer case, and means for introducing ashes into the ash receptacle which is provided at the outer case.

17 Claims, 3 Drawing Sheets

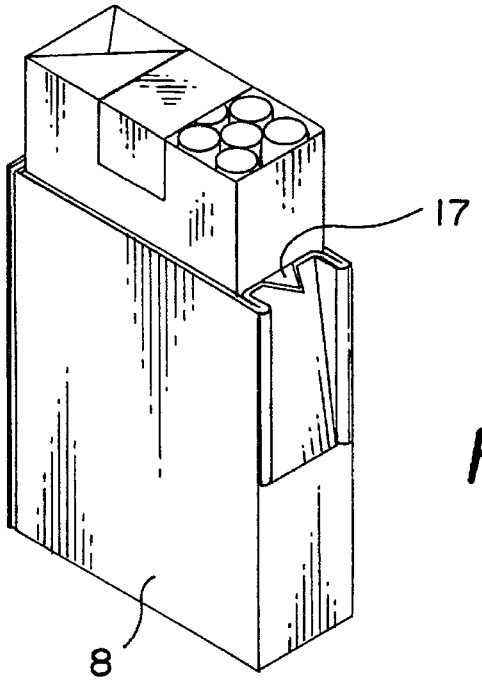
FIG. 3B
FIG. 4
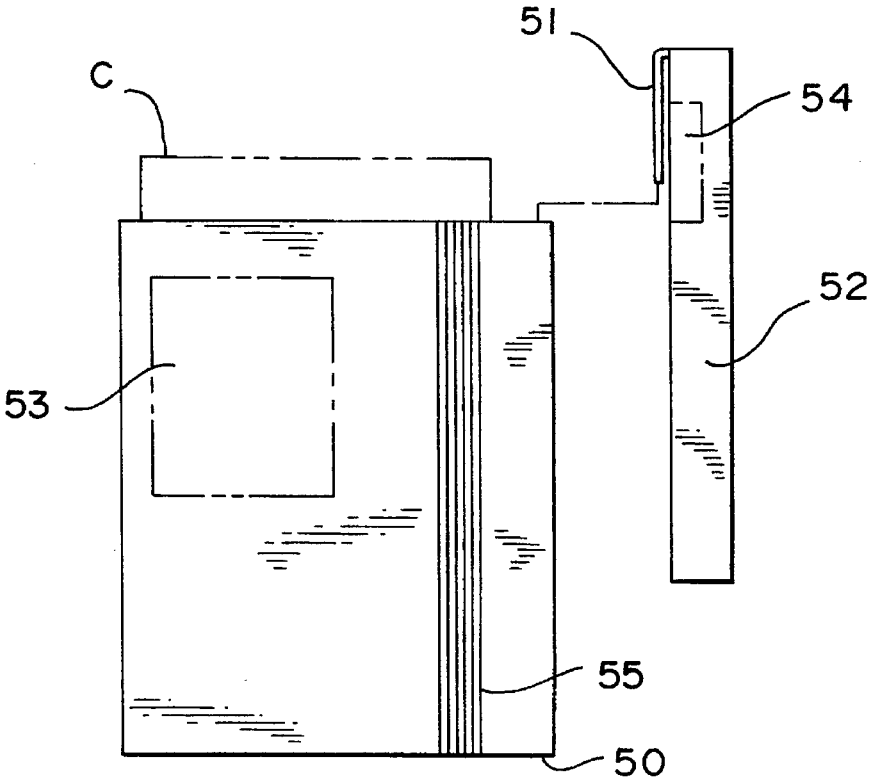

CIGARETTE CASE EQUIPPED WITH DISPOSABLE ASH RECEPTACLE

BACKGROUND OF THE INVENTION

1. Field of the Invention

The present invention relates to a cigarette case for containing a pack of cigarettes, and more particularly to a cigarette case for containing a pack of cigarettes which is equipped therein with a plurality of disposable ash receptacles.

2. Description of the Prior Art

In general, a smoker carries a pack of cigarettes and a lighter. In order to smoke a cigarette, the smoker takes out the cigarette and the lighter and lights the cigarette. When the smoker smokes a cigarette on the road, it is difficult for him to throw the cigarette ashes and the cigarette-butt into a trash can because the most of the roads are not provided with abundant trash cans.

Hence, a cigarette case having an ash receptacle, which is designed so as not to throw the cigarette ashes and the cigarette-butt to the road during walking, has been developed, as shown in FIG. 4. The cigarette case comprises an outer case 50 receiving a pack of cigarettes "C", an ash receptacle 52 mounted to a side of the outer case 50 by means of its clip member 51, a match 53 inserted into the outer case 50 and a snap extinguishing member 54 formulated in the ash receptacle 52.

Also, the cigarette case is formed with longitudinal wrinkles 55 so that the walls of the outer case 50 are expanded and the ash receptacle 52 is inserted into the expanded outer case 50.

In use of the above conventional cigarette case, the smoker takes out a cigarette and the match 53 from the cigarette case and then lights the cigarette. When ashes are generated from the cigarette during smoking, the smoker inserts the cigarette into the ash receptacle 52 and flicks the ashes from the cigarette. Subsequently, when the cigarette is fully consumed, the smoker inserts the burned end of the cigarette-butt into the snuff extinguishing member 54 to extinguish the cigarette and then throws the cigarette-butt into the ash receptacle 52.

However, since the above-mentioned cigarette case is provided with the ash receptacle 52 detachably mounted to an outside thereof, it is anxious about loss of the ash receptacle 52 and also the overall size of the cigarette case becomes large. Furthermore, since the ash receptacle 52 is hung on the outer case 50 by means of the clip member 51, the ash receptacle 52 can not be firmly mounted on the outer case 50 and therefore its carriage is troublesome.

U.S. Pat. No. 4,789,059 issued on Dec. 6, 1988 discloses another type of a cigarette case which includes an ash tray which is pivotally mounted to the cigarette case for being pulled out therefrom when the ash tray is necessary for use, and a container disposed in the bottom portion thereof for receiving and keeping ash and butts introduced through the ash tray.

However, since the insides of the outer case and ash tray of the above cigarette case are in touch with ash and butts directly, its span of use can not be long due to nauseous smell of ashes and butts soaked into the insides of the outer case and ash tray or damage on the outer case or ash tray caused by the burning butts.

SUMMARY OF THE INVENTION

The present invention has been made in view of the above-described problems occurring in the above-mentioned cigarette case and an object of the invention is to provide an improved cigarette case which is provided therein a disposable ash receptacle to facilitate its carriage and lengthen its span of use.

Another object of the invention is to provide a cigarette case equipped with a disposable ash receptacle which is designed to receive and keep plenty of cigarette ashes and cigarette-butts.

A further object of the invention is to provide a cigarette case which is provided with a plurality of stacked disposable ash receptacles such that each of the receptacles can receive and keep cigarette ashes and cigarette-butts and then can be discarded conveniently, and subsequently the next one of the ash receptacles can receive ashes and cigarette-butts.

In accordance with the present invention, the objects of the invention can be accomplished by providing a cigarette case comprising: an inner case for containing a pack of cigarettes; an inner cap covering an upper opening of the inner case; an ash receptacle consisting of a plurality of stacked sheet pockets such as silver paper pockets in which the inner case is inserted and which is formed at its upper portion with an ash inlet; a snuff extinguishing member provided at a side of the inner case; an outer case for containing the inner case, the ash receptacle and the snuff extinguishing member which is formed at its upper portion with a cutout portion so as to open the ash inlet therethrough; an outer cap covering an upper opening of the outer case; and means for introducing ashes into the ash receptacle which is provided at the outer case.

BRIEF DESCRIPTION OF THE DRAWINGS

These and other objects and aspects of the invention will become apparent from the following description of an embodiment with reference to the accompanying drawings in which:

FIG. 3B is a view similar to FIG. 3A, in which the expansible inlet is closed; and FIG. 4 is an elevation view of a conventional cigarette case.

DETAILED DESCRIPTION OF THE PREFERRED EMBODIMENTS

Embodiments according to a cigarette case of the present invention will be described with reference to the accompanying drawings hereinafter.

Figure 1:
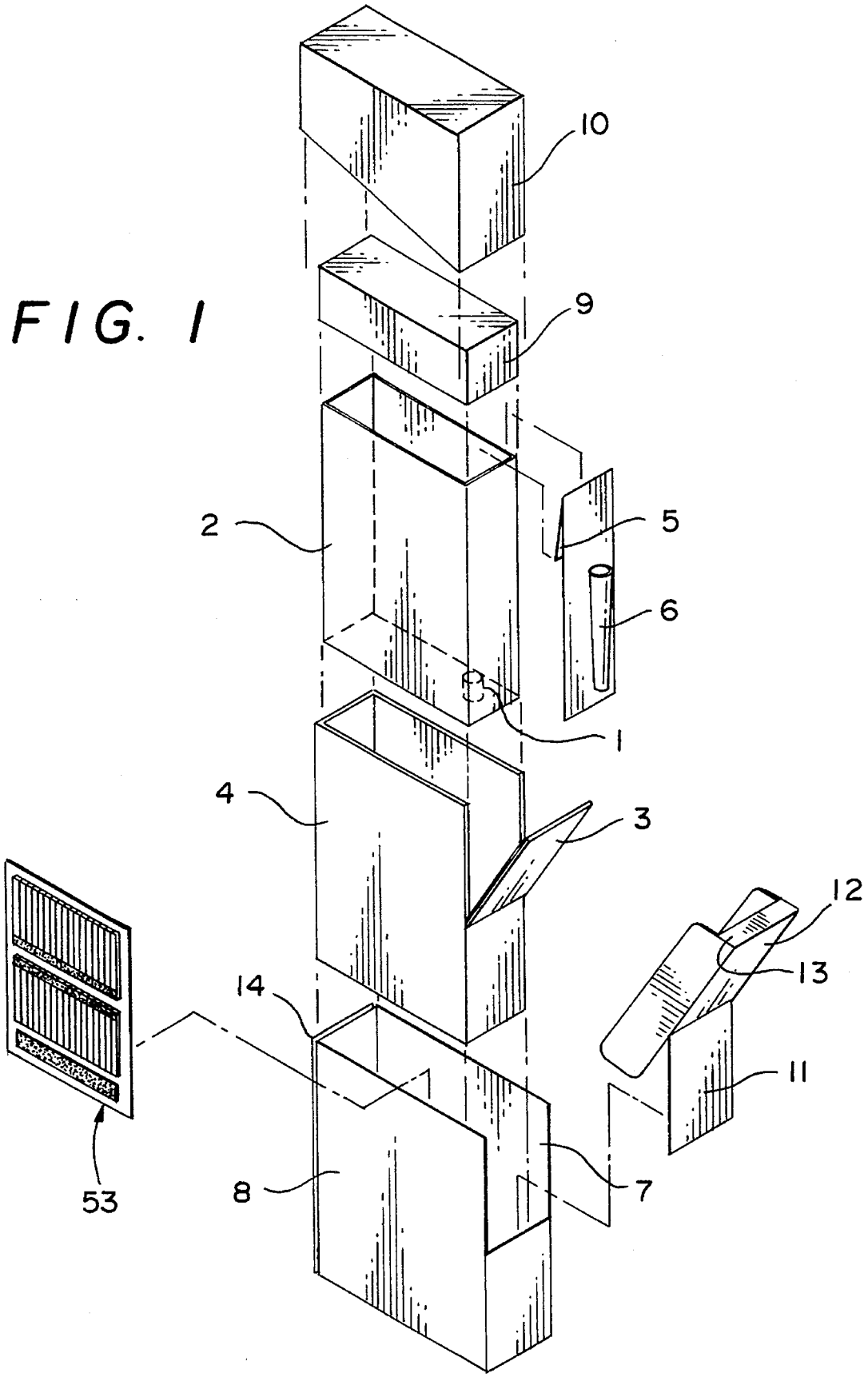
FIG. 1 is an exploded perspective view of a cigarette case according to an embodiment of the present invention.
Figure 2:
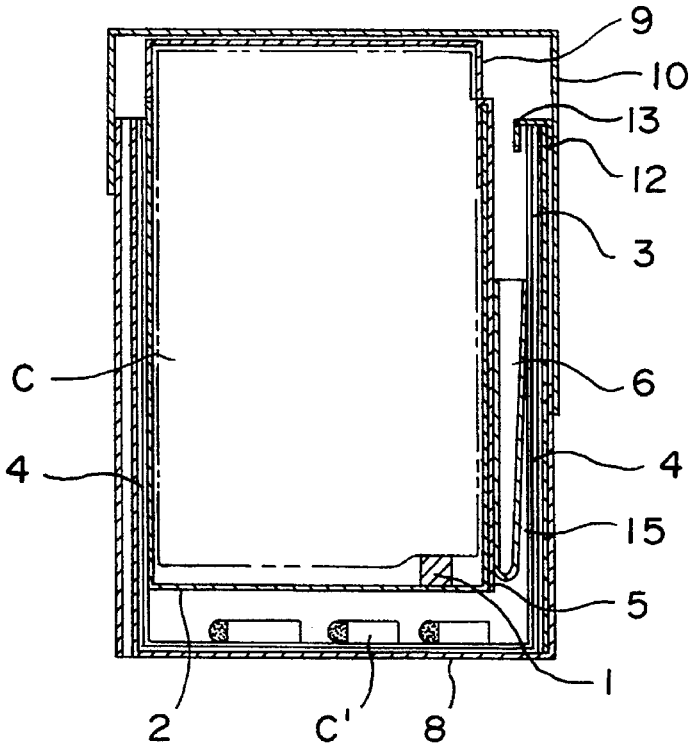
FIG. 2 is a sectional view of the cigarette case shown in FIG. 1.

FIGS. 1 and 2 are an exploded perspective view and a sectional view showing a cigarette case according to the invention. As shown in the drawings, the cigarette case comprises an inner case 2 for containing a pack of cigarettes "C" which is provided at its bottom with a cigarette lifting member 1, an ash receptacle 4 made of a sheet such as a silver paper in which the inner case 2 is inserted and which is formed at its upper portion with an ash inlet flap 3, a snuff extinguishing member 6 detachably mounted on the inner case 2 by means of its clip 5, an outer case 8 for containing the inner case 2, the ash receptacle 4 and the snap extinguishing member 6 which is formed at its upper portion with a cutout portion 7 so as to open the ash inlet flap 3 therethrough, and means for introducing ashes into the ash receptacle 4 which is integrally formed with or detachably mounted on the outer case 8.

The snap extinguishing member 6 is formed into a conical shape such that a cigarette can be instantly extinguished due to interception of air at time moment of insertion of the cigarette.

The inner and outer cases 2 and 8 are covered with inner and outer caps 9 and 10 for preventing foreign substance from introducing thereinto, respectively. A match 53 is inserted between the outer case 8 and the ash receptacle 4. The ash receptacle 4 comprises a plurality of ash receptacle pockets which are stacked one in another. Therefore, after the most inner ash pocket containing ashes and cigarette-butts is taken out of the next one and discarded, the next new one is automatically prepared for reception of ashes and cigarette-butts.

The introducing means comprises a chute member 12 pivotally secured to the outer case 8 by attaching its attaching plate 11 to a portion below the cutout portion 7 of the outer case 8 and appearing to be integral with the outer case 8 when it is closed, and a holding member 13 provided at an upper end of the chute member 12 and holding an upper end of the ash inlet flap 3 of the ash receptacle 4.

In this case, the holding member 13 is formed into an L-shape by folding the chute member 12 inward so that the holding member 13 receives the upper end of the ash inlet flap 3.

The outer case 8 is formed at a side with a wrinkle portion 14 such that a space for receiving an empty pack of cigarettes is provided between the outer case 8 and the ash receptacle 4 when the wrinkle portion is expanded. The inner case 2 is disposed in the ash receptacle 4 with a predetermined spacing therebetween to provide a path space 15 for receiving cigarette-butts "C'" and cigarette ashes.

In use of the cigarette case of the invention, the smoker inserts a pack of cigarettes "C" into the cigarette case of the invention for preparation of use. In this state, as the smoker pushes the pack of cigarettes "C" into the cigarette case, the lifting member 1 pushes one of cigarettes contained in the pack "C" upward so that the pushed cigarette can be easily taken out thereof.

After the smoker has taken out the cigarette from the pack of cigarettes "C", he takes out the match 53 disposed at inside of the outer case 8 and lights the cigarette by the match 53. At this time, the inner and outer caps 9 and 10 are separated from the inner and outer case 2 and 8. Thereafter, the smoker pulls the chute member 12 outward. As the chute member 12 is opened, the ash inlet flap 3 held in the holding member 13 of the chute member 12 is also pulled and opened. In this state, ashes generated from the cigarette during smoking is flicked at and introduced into the ash inlet flap 3 of the ash receptacle 4.

Ashes flicked at the ash inlet flap 3 are introduced along the ash inlet flap 3 and then introduced into the path space 15. In this state, when the inner case 2 is raised from the ash receptacle 4 by a predetermined distance, a space is provided between the bottom of the inner case 2 and the ash receptacle 4. Therefore, the ashes or cigarette-butts "C'" are introduced into the path space 15 and stored in the space between the inner case 2 and the ash receptacle 4.

That is, since the ashes or the cigarette-butts "C'" can not be seen from outside, it is possible to maintain appearance of the cigarette case to be clean. In addition, since the chute member 12 can be closed after reception of ashes, emission of nauseous smell of cigarette can be prevented and carriage of the cigarette case is convenient. When it is necessary to discard a fully consumed cigarette-butt "C'", the cigarette-butt "C'" is inserted into the snuff extinguishing member 6 to be quickly extinguished and the extinguished cigarette-butt "C'" is stored in the ash receptacle 4 through the chute member 12.

In this embodiment, since the snuff extinguishing member 6 is detachably mounted on the inner case 2 by means of its clip 5, the pack of cigarettes "C" may be separated from the inner case 2 and then the snuff extinguishing member 6 may be attached to an outside of the inner case 2, thereby allowing several people to use it. The snuff extinguishing member 6 may be integrally formed with the inner case 2.

Although the chute member 12 is formed separately from the outer case 8 and the its attaching plate 11 is attached to a portion below of the cutout portion 7 of the outer case 8 by adhesive, it is possible to obtain the same effect as that of the separated chute member even when the chute 12 is integrally formed with the outer case 8.

Figure 3A:
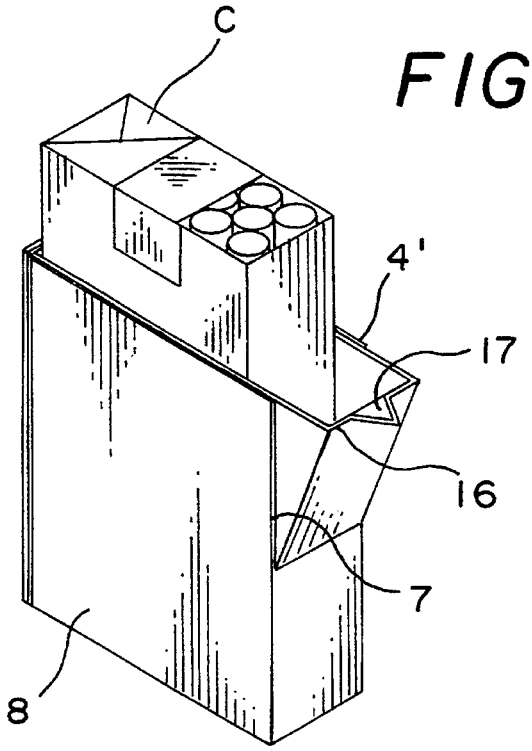
FIG. 3A is a perspective view of a cigarette case according to another embodiment of the invention, in which an expansible inlet is opened.

Referring to FIGS. 3A and 3B, there are shown another embodiment according to ash introducing means of the invention. As shown in the drawings, the outer case 8 surrounding an ash receptacle 4' is provided with an expansible inlet 16 protruded from the cutout portion 7. The expansible inlet 16 is formed at its upper end with a knob 17. Therefore, when ashes or a cigarette-butt is introduced into the ash receptacle 4', the smoker opens the expansible inlet 16 and the inlet flap 3 of the ash receptacle 4' by pulling the knob 17 and then inserts the ash or the cigarette-butt "C'" into the expansible inlet 16.

The ash or the cigarette-butt "C'" introduced into the expansible inlet 16 is introduced into a lower space of the ash receptacle 4' through the path space 15 as shown in FIG. 2. Therefore, the ash or the cigarette-butt "C'" stored in the ash receptacle 4' can not be seen from the outside.

As apparent from the above description, according to the invention, the ash receptacle is disposed between the inner and outer cases with the path space provided between the ash receptacle and the inner case and the ash introducing means is provided at an upper portion of the outer case such that ashes or a cigarette-butt is introduced into the introducing means and the path space and stored in the receptacle. Therefore, the cigarette case of the invention can be reduced in size, facilitated in carriage and used as new one only by exchanging the ash receptacles.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cigarette case, comprising:

a) an inner case for containing a pack of cigarettes, said inner case having an outer bottom surface;

b) an ash receptacle for receiving and supporting therein said inner case, said ash receptacle having an inner bottom surface being disposed away from said inner case outer bottom surface thereby to provide a chamber therebetween;

c) an outer case for receiving and supporting therein said ash receptacle, said outer case including a cutout portion;

d) said inner case including an outer side surface disposed away from a side wall of said ash receptacle, thereby providing a passageway communicating with said chamber;

e) a conical member secured to said outer side surface of said inner case for snuffing a cigarette butt, said conical member being disposed within said passageway;

f) said side wall of said ash receptacle including a pivotable cutout flap portion movable outwardly through said outer case cutout portion to expose said passageway and said conical member; and g) a chute member operably secured to said flap and said outer case, said chute member having opposed side walls operably associated with said flap such that said opposed side walls are adapted to contain the ash when said flap is moved outwardly.

2. A cigarette case as in claim 1, wherein:

a) said chute member is pivotably secured to said outer case.

3. A cigarette case as in claim 2, wherein:

a) said chute member includes an attaching plate secured to below said cutout portion.

4. A cigarette case as in claim 1, wherein:

a) said chute member includes a holding member for attaching to an upper end portion of said flap.

5. A cigarette case as in claim 1, wherein:

a) said ash receptacle comprises a plurality of stacked sheet pockets.

6. A cigarette case as in claim 1, wherein:

a) said conical member includes a clip for detachably securing to said inner case.

7. A cigarette case as in claim 1, wherein:

a) said outer case includes an expansible wrinkle portion.

8. A cigarette case as in claim 1, wherein:

a) said inner case includes a lifting member adapted to move upwardly a cigarette in a pack, thereby to permit a smoker to retrieve the cigarette from the pack.

9. A cigarette case as in claim 1, wherein:

a) said inner case includes an inner cap.

10. A cigarette case as in claim 1, wherein:

a) said outer case includes an outer cap adapted to enclose said chute member.

11. A cigarette case, comprising:

a) an inner case for containing a pack of cigarettes, said inner case having an outer bottom surface;

b) an ash receptacle for receiving and supporting therein said inner case, said ash receptacle having an inner bottom surface being disposed away from said inner case outer bottom surface thereby to provide a chamber therebetween;

c) an outer case for receiving and supporting therein said ash receptacle;

d) a chute member secured to said outer case and foldable into said outer case and expansible therefrom;

e) said inner case including an outer side surface disposed away from a side wall of said ash receptacle, thereby providing a passageway communicating with said chamber;

f) a conical member secured to said outer side surface of said inner case for snuffing a cigarette butt, said conical member being disposed within said passageway; and g) said side wall of said ash receptacle including a pivotable cutout flap portion movable outwardly into said chute member when said chute member is expanded from said outer case, thereby to expose said passageway and said conical member.

12. A cigarette case as in claim 11, wherein:

a) said ash receptacle comprises a plurality of stacked sheet pockets.

13. A cigarette case as in claim 11, wherein:

a) said conical member includes a clip for detachably securing to said inner case.

14. A cigarette case as in claim 11, wherein:

a) said outer case includes an expansible wrinkle portion.

15. A cigarette case as in claim 11, wherein:

a) said inner case includes a lifting member adapted to move upwardly a cigarette in a pack, thereby to permit a smoker to retrieve the cigarette from the pack.

16. A cigarette case as in claim 11, wherein:

a) said inner case includes an inner cap.

17. A cigarette case as in claim 11, wherein:

a) said outer case includes an outer cap adapted to enclose said chute member.

* * * * *